United States Patent [19]

Kondo et al.

[11] 4,279,500

[45] Jul. 21, 1981

[54] ELECTROPHOTOGRAPHIC APPARATUS AND AN ABRADING MEANS

[75] Inventors: Hideyo Kondo, Toride; Keiichi Murai, Abiko, both of Japan

[73] Assignee: Canon Kabushiki Kaisha, Tokyo, Japan

[21] Appl. No.: 34,208

[22] Filed: Apr. 27, 1979

[30] Foreign Application Priority Data

Apr. 27, 1978 [JP] Japan ..... 53-50626
Oct. 14, 1978 [JP] Japan ..... 53-126699

[51] Int. Cl.[3] ..... G03G 21/00
[52] U.S. Cl. ..... 355/15; 118/652
[58] Field of Search ..... 355/15, 3 R, 10; 118/652

[56] References Cited

U.S. PATENT DOCUMENTS 3,910,697 10/1975 Lanker ..... 355/15 X
4,078,924 3/1978 Kiddie et al. ..... 355/15 X

OTHER PUBLICATIONS

Xerox Disclosure Journal, vol. 2, No. 5, p. 107, Sep.-/Oct. 1977.

*Primary Examiner*—William H. Beha, Jr.
*Attorney, Agent, or Firm*—Fitzpatrick, Cella, Harper & Scinto

[57] ABSTRACT

An electrophotographic apparatus includes an image holding member which is adapted to retain electrostatic images as well as toner images. The image holding member contains a lubricating agent inside the surface layer. To expose a new surface of the member to provide additional lubricating agent, a means to abrade the surface layer is also provided.

14 Claims, 2 Drawing Figures

ELECTROPHOTOGRAPHIC APPARATUS AND AN ABRADING MEANS

BACKGROUND OF THE INVENTION

1. Field of the Invention

This invention relates to an electrophotographic apparatus and particularly, to an electrophotographic apparatus having an image-holding member of improved durability and cleaning property for holding electrostatic images and/or toner images.

2. Description of the Prior Art

An electrostatic image or toner image is formed by various electrophotographic processes. As the image-holding member on which an electrostatic image or toner image is formed, there are an electrophotographic photosensitive member and other image-holding members.

The electrophotographic photosensitive members as variously constituted are prepared according to the predetermined characteristics of the members and electrophotographic process to be applied thereto. As typical photosensitive members, there are members having a photoconductive layer formed on a support and members provided with an insulating layer on the surface of the former member. These members are used in wide fields. The photosensitive member consisting of a support and photoconductive layer is employed in the image formation based on the most general electrophotographic process which comprises charging, image exposing and developing steps, and further a transferring step if desired. As for the photosensitive member provided with an insulating layer, such layer is formed for the purpose of protecting the photoconductive layer, improving the mechanical strength of the photosensitive member, enhancing the dark decay characteristic of the member, or adapting the member to the specified electrophotographic process. Typical photosensitive members having such an insulating layer or examples of the electrophotographic process using the member having an insulating layer are disclosed, for example in U.S. Pat. No. 2,860,048, Japanese Patent Publication No. 16429/1966, and U.S. Pat. Nos. 3,146,145; 3,607,258; 3,666,363; 3,734,609; 3,457,070; and 3,124,456.

To the electrophotographic photosensitive member, the predetermined electrophotographic process is applied so that an electrostatic image is formed, and then the image is visualized by development.

Process for using and forming some of the typical image-holding members other than the electrophotographic photosensitive member will be given below:

(1) Image-holding member used in the electrophotographic process which comprises forming an electrostatic image on a photosensitive member, transferring the image to the image-holding member for the purpose of improving the repeating usability of the photosensitive member, developing the transferred image and transferring the toner image to a recording material. This process is disclosed, for example in Japanese Patent Publication Nos. 7115/1957, 8204/1957 and 1559/1968.

(2) Image-holding member used in the electrophotographic process which comprises forming an electrostatic image on an electrophotographic photosensitive member in a screen form having a large number of fine openings by the predetermined electrophotographic process, applying corona charging treatment to the image-holding member through the electrostatic image to modulate the ion flow from the corona so that the electrostatic image is formed on the above image-holding member, developing such image with a toner, and transferring the toner image to a recording material thereby forming the final image. This process is disclosed, for example in Japanese Patent Publication Nos. 30320/1970 and 5063/1973, and Japanese Patent Laid Open No. 341/1976 as the electrophotographic process in which an electrostatic image corresponding to that formed on the photosensitive member is formed on the image-holding member.

(3) Image-holding member employed in the electrophotographic process which comprises forming a toner image on an electrophotographic photosensitive member, transferring the toner image to the image-holding member without directly transferring it to a recording material, and transferring the toner image from the image-holding member to a recording material followed by fixation. This process is effective, particularly for forming a color image and copying at a high speed. Most of the recording materials are usually flexible, such as for example paper and film. As a result, in case of transferring cyan, magenta and yellow images directly onto such a recording material, it is difficult to register the positions of the images. On the contrary, if the cyan, magenta and yellow images are transferred onto the image-holding member which can be formed from a barely deformable material with the positions of the images registered and the transferred image is further transferred onto the recording material, a color image in which the positions of the images are more exactly registered can be obtained on the recording member. In addition, it is also effective for high speed copying such that a toner image is transferred to a recording material through the image-holding member.

(4) Image-holding member employed in the electrophotographic process which comprises applying electric signal to the multi-stylus electrode to form an electrostatic image corresponding to the electric signal on the image-holding member and developing the image. The image-holding members (1)–(4) do not require a photoconductive layer.

As mentioned above, not only the electrophotographic photosensitive member, but also various members having an insulating property at the surface are employed as the image-holding member on which an electrostatic image or toner image is formed. Usually, the surface of the image-holding member is reused many times. Upon reuse, new toner image is repeatedly formed on the surface of the image-holding member each time the process for forming the toner image is repeated. Therefore, it is necessary to remove totally the toner remaining on the surface of the image-holding member and to clean such surface when the process cycle for the image formation is completed, that is, after the toner image is transferred. As the method of removing the remaining toner, there are: the method of wiping and scraping the toner off the surface of the image-holding member by a cleaning blade, the method of wiping off the toner by a web like material to rub the surface of the member, the method of wiping off the toner by a fur brush and the like, and other methods. However, when the toner remaining on the surface of the image-holding member is removed by those methods, the cleaning efficiency of the methods is lowered in most cases as the frequency of using repeatedly the image-holding member is increased, and as a result, even if the surface of the image-holding member is cleaned by the methods, a portion of the toner remains on the surface.

The cause of this phenomenon is that the lubricating property of the surface of the image-holding member is lowered and therefore, separation of the toner becomes difficult.

Cleaning according to the above-mentioned method is conducted by a mechanical dynamic contact between the surface of the image-holding member and the cleaning means. Therefore, once the toner, remaining on the surface of the member at the time of cleaning the surface, agglomerates or fuses resulting in adhering to the surface of the image-holding member, then a ghost image or stripe appears on the formed toner image, or the surface of the image-holding member is damaged. Further, in case of an image-holding member such as a photosensitive member, the photoconductive layer is peeled off and in case of an image-holding member such as a member composed of a photoconductive layer and an insulating layer overlying the photoconductive layer, the insulating layer is peeled.

Further, when corona discharging is repeated as the charging treatment for forming an electrostatic image on the image-holding member and the member is exposed to the corona discharging for a long time, the electric characteristics in the surface of the member are deteriorated due to the formation of corona ion. This phenomenon is caused by the fact that ionized oxygen, nitrogen, carbonic acid gas, water, ammonia and the like are generated by the energy at the time when the corona ion collides directly with the surface of the image-holding member or by the corona discharging. They adhere to the surface of the member so that the molecule of the material constituting the surface is broken or oxidized and the surface of the member is deteriorated, or the above mentioned ionized substance adsorbs moisture. As a result, the surface electric resistance of the image-holding member is lowered, and therefore such member cannot retain the electrostatic charge so that the member cannot be used as the desired image-holding member.

For the purpose of reusing the image-holding member to which the remaining toner adheres or whose electric characteristic is deteriorated, it is necessary to recover the initial surface state of the member by abrading the surface to expose a new surface.

For such recovery of the initital surface characteristics, a conventional technique such as described in Japanese Patent Laid Open No. 47346/1973 employs a developer containing both abrasive and lubricating agent so as to maintain lubricating property of the surface of the image-holding member and abrade the surface of the image-holding member to expose a new surface. However, it is difficult to keep the ratio of the abrasive to the lubricating agent constant and physical properties of the developer are deteriorated.

SUMMARY OF THE INVENTION

An object of the present invention is to provide an electrophotographic apparatus capable of easily and surely maintaining the lubricating property of the surface of the image-holding member and abrading the surface so as to expose a new surface.

Another object of the present invention is to provide an electrophotographic apparatus in which the image-holding member is not contaminated by a toner even when used for a long period of time.

A further object of the present invention is to provide an electrophotographic apparatus capable of producing sharp and clear images even when used for a long period of time.

According to one aspect of the present invention, there is provided an electrophotographic apparatus which comprises an image-holding member for electrostatic images and/or toner images, the image-holding member containing a lubricating agent inside of the surface of the member, and a means to abrade the surface to expose a new surface of the image-holding member by contacting the surface of the image-holding member.

According to another aspect of the present invention, there is provided a means to abrade the surface of an image-holding member for electrophotography holding electrostatic images and/or toner images to expose a new surface of the image-holding member by contacting the surface of the image-holding member with a resin grinder which comprises a water soluble resin containing an abrasive dispersed therein.

BRIEF DESCRIPTION OF DRAWINGS

The invention will now be described in greater detail with reference to the drawings in which.

DESCRIPTION OF THE PREFERRED EMBODIMENTS

Figure 1:
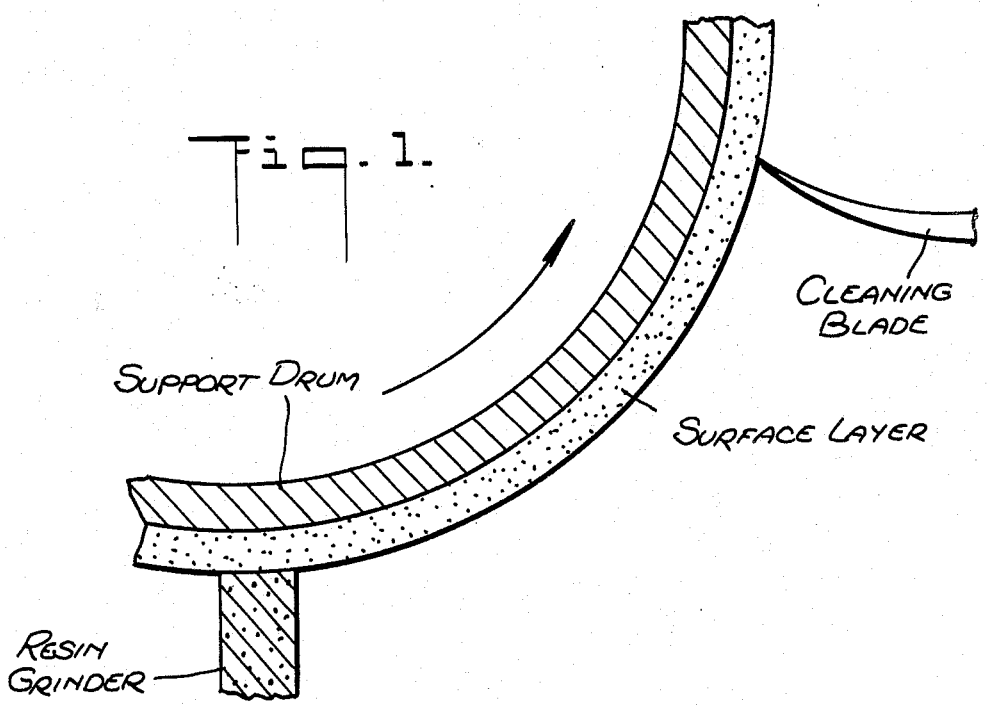
FIG. 1 shows schematically in broken cross-section one embodiment of the invention employing a contact-abrading member.

The objects of the present invention can be attained by always exposing effectively the lubricating agent present inside of the surface of the image-holding member by using an abrading means.

Presence of a lubricating agent exposed at the surface of the image-holding member is necessary for the lubricating agent to effectively continue the lubrication.

At the start of using an image-holding member, the lubricating agent is effectively exposed, but during the repeated use, the lubricating effect is gradually lowered. The causes of this lowering of lubricating effect are that the effective exposure of the lubricating agent can not be maintained any more as the result of consumption of the exposed lubricating agent and that the lubricating agent is covered by degraded and contaminative matter formed by corona discharge.

According to the present invention, the surface of the image-holding member is abraded to expose a new surface and thereby an effective exposure of the lubricating agent can be maintained in spite of consumption of the lubricating agent at the surface, and further the degraded and contaminative matter formed by corona discharge are removed and thereby the image-holding member can be used for a long time without deteriorating the characteristics.

The most representative structure of an image-holding member when the image-holding member is a photosensitive member for electrophotography is a laminate composed of a photoconductive layer and a support.

The support may be selected from stainless steel, copper, aluminum, tin and the like metal plate, and paper, sheet and resin film. Further, the support may be omitted if desired.

The photoconductive layer may be formed by the vacuum deposition of an inorganic photoconductive material such as S, Se, PbO, an alloy, intermetallic compound and the like. The alloy and intermetallic compound may contain any of S, Se, Te, As, Sb and the like. Alternatively, in accordance with the sputtering method, a photoconductive substance having a high melting point, for example ZnO, CdS, CdSe, and $TiO_2$ may be deposited onto a support to form a photoconductive layer. In case of forming a photoconductive layer by the coating method, there may be used an organic photoconductive material such as polyvinyl carbazole, anthracene, phthalocyanine and the like, wherein those materials are sensitized with a dye or Lewis acid, and a mixture of those materials with an insulating binder. In the latter case, a mixture of an inorganic photoconductive material such as ZnO, CdS, $TiO_2$ and PbO etc. and an insulating binder may be preferably employed. Such insulating binder includes various kinds of resins. The thickness of the photoconductive layer may vary depending upon the nature or property of the photoconductive material. It may be usually about 5–100 microns, and preferably about 10–50 microns.

An insulating layer may be formed on the image-holding member. When the insulating layer is formed mainly for the purposes of protecting the image-holding member and improving the durability and dark decay property of the member, the thickness of such layer may be relatively thin. But, when an insulating layer is provided for the purpose of adapting the image-holding member to the specific electrophotographic process, it may be relatively thick. The thickness of the insulating layer may be usually 0.1–100 microns, and preferably 0.1–50 microns. The insulating layer may be formed from various resins, for example, polyethylene, polyester, polypropylene, polystyrene, polyvinyl chloride, polyvinyl acetate, acrylic resin, urethane resin, polycarbonate, silicone resin, fluorine-containing resin and epoxy resin.

When the image-holding member does not have a photoconductive layer, the most representative structure is a support and an insulating layer overlying the support. The support may be omitted if desired.

The lubricating agent may be added by, for example, incorporating the lubricating agent in a material used for a surface layer of the image-holding member, such as a photoconductive layer, an insulating layer and the like and then forming the surface layer with the material containing the lubricating agent.

When the surface layer is a photoconductive layer, it is preferable to form the photoconductive layer by coating for the purpose of adding a lubricating agent.

When the surface layer is an insulating layer, there may be used curable resins having a high mechanical strength such as acrylic resins, urethane resins, polyester resins, melamine resins, silicone resins and the like as an insulating layer material. Since curable resins have a poor lubricating property, addition of a lubricating agent is very effective.

A lubricating agent is usually contained in the surface layer of the image-holding member in a form of solid particles.

Particle size of the lubricating agent may be appropriately selected. It is usually 0.1–20 microns, preferably 0.1–5 microns.

The amount of the lubricating agent in the surface layer of the image-holding member may be optionally determined. It is usually 0.5–80 wt.%, preferably 3–50 wt.%, based on the weight of the insulating layer.

When images are formed by using an image-holding member containing a lubricating agent, the imagewise exposure may be carried out from the support side.

As a lubricating agent, according to the present invention, there may be used optionally a material showing an excellent lubricating property in connection with a developer.

Representative lubricating agents are resins such as polytetrafluoroethylene, polyvinylidene fluoride, polystyrene, polyethylene, polyethylene terephthalate, polybutylene terephthalate, silicone resin, polyvinyl chloride, polytrifluoro-chloroethylene, neoprene, polypropylene, tetrafluoroethylene-propylene copolymer, polyparaxylylene and the like, waxes such as fluorine wax, paraffin wax, synthetic wax and the like, fatty acid amides such as oleic acid amide, stearic acid amide, lauric acid amide, phthalic acid amide, capric acid amide, palmitic acid amide and the like, metal salts of fatty acids such as metal (e.g. Zn, Mg, Ca and K) salts of stearic acid, oleic acid, lauric acid, phthalic acid, capric acid and the like, carbons such as carbon fluoride, graphite and the like, molybdenums such as molybdenum, molybdenum disulfide, and the like, boron nitride, talc, metal carbonate, silicon dioxide and the like.

It is preferable that the lubricating agent is substantially insoluble in usual solvents.

As the abrading means, there may be optionally employed various means to abrade the surface of an image-holding member. Representative means to abrade are a contact-abrading member and a developer containing abrasive. A contact-abrading member is a member which is pressed to the surface of an image-holding member. An elastic material is suitable for a contact-holding member.

As the contact-abrading member, there may be used abrading cloth, resin grinder, and sponge.

Abrading cloth has a flocculent surface which serves to abrade.

A resin grinder is a resin in which an abrasive composed of hard particles is dispersed and a part of the hard particles appear at the surface of the resin member. As a material for the hard particles, there may be mentioned metal oxides such as cerium oxide, magnesium oxide, chromium oxide, aluminum oxide, silica and the like, metal sulfates such as strontium sulfate, calcium sulfate, barium sulfate, magnesium sulfate, aluminum sulfate and the like, metal carbonates such as calcium carbonate and the like, metal silicates such as magnesium silicate, calcium silicate and the like, boron nitride, carbon and the like.

Among them, cerium oxide, silicon oxide, calcium carbonate and barium sulfate are particularly preferable.

In the above case, an amount of the abrasive is preferably 0.1–70% by weight, more preferably 0.5–40% by weight, based on the total amount of resin and abrasive. Since a resin grinder has abrasive particles fixed in a resin, the abrasive particles do not fly apart and the abrading effect is particularly excellent.

As a resin for a resin grinder, there may be employed optionally various resins. Representative resins are for example, polyethylene, polyester, polypropylene, polystyrene, polyvinyl chloride, polyvinyl acetate, acrylic resins, urethane resins, polycarbonates, silicone resins, fluorine containing resins, and epoxy resins.

Further, there can be used rubberlike resins such as urethane rubber, butadiene rubber, natural rubber, isoprene rubber, isobutylene-isoprene rubber, butyl rubber, butadiene rubber, butadiene-styrene rubber, nitrile rubber, chloroprene rubber, chlorinated polyethylene, fluorine-containing rubber, silicone rubber and the like.

The abrading function of the resin grinder is effected in such a way that the surface of an image-holding member is rubbed by the abrasive exposed on the resin surface of the resin grinder. After using the resin grinder for a certain period of time, the abrasive particles initially exposed on the resin surface of the resin grinder contributing to abrasion are worn out and therefore the abrading ability is lost. If the resin material of the resin grinder is such that it can be worn out appropriately, the resin itself is also worn out as the abrasive particles exposed on the resin surface are worn out. Therefore, abrasive particles present near the surface of the resin grinder become exposed on the surface and the newly exposed abrasive particles work as abrasive and thus the durability of the resin grinder is further improved.

In view of the foregoing, it is desirable that the resin material of the resin grinder accordingly can be appropriately worn out, and for such purpose, the pencil hardness of the resin material is preferably from 0.05H–3.0H, more preferably from 0.5H–2.5H.

As a resin which can be appropriately worn out, there may be mentioned resins of linear structure such as phenoxy resins, polyether resins, polycarbonate resins, polyethylene resins, fluorine containing resins, polyvinyl chloride, polyvinyl acetate, vinyl chloride-vinyl acetate copolymers, polyurethane resins, acrylic resins, epoxy resins, silicone resins and the like.

Figure 2:
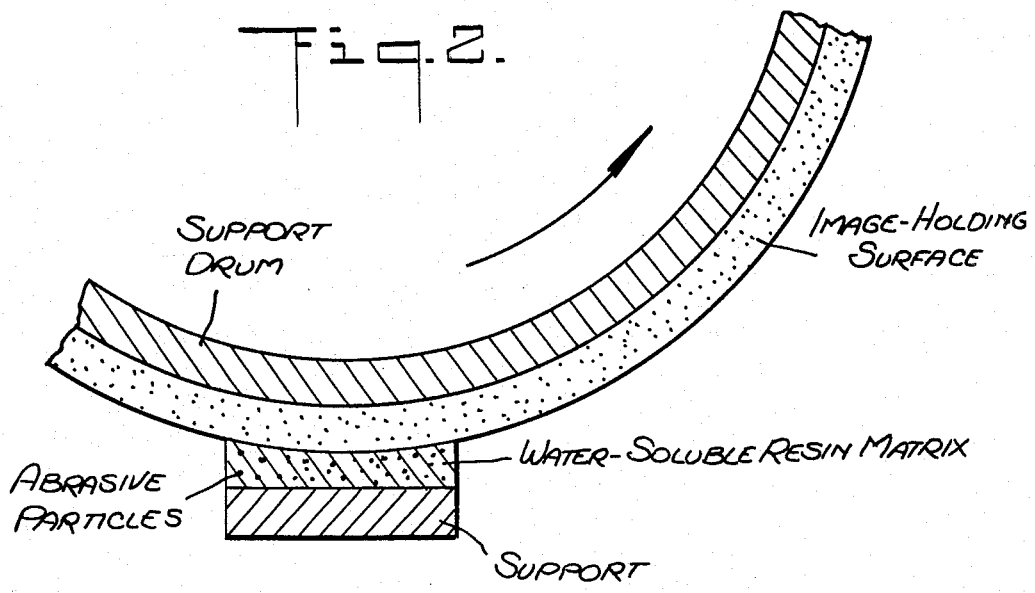
FIG. 2 illustrates schematically in broken cross-section a second embodiment of the invention employing a resin grinder having a water-soluble, resin-containing abrasive.

As a resin which can be appropriately worn out and is well adapted to contain uniformly dispersed abrasive particles, there is a water soluble resin as shown in FIG. 2.

A water soluble resin in excellent since even an abrasive which usually cannot be uniformly dispersed due to its high specific gravity can be easily dispersed uniformly in a water soluble resin.

Therefore, a resin grinder which is produced by dispersing abrasive particles in a water soluble resin and applying the water soluble resin to a carrying member has an excellent uniform and plain surface, and its abrading function can continue for a long time. It is considered that a water soluble resin can give an excellent resin grinder because a water soluble resin behaves as a surfactant and thereby the abrasive particles can be stably dispersed.

During use of a resin grinder for a long period of time, a part of the water soluble resin constituting the resin grinder is hardly transferred to the surface of an image-holding member and thereby chargeability and corona resistance under a highly humid condition and cleaning property of the image-holding member are not adversely affected.

As a water soluble resin, there may be mentioned high polymers having hydroxy group, ether bond, carboxyl group, or carboxylic acid salt as a side chain such as polyvinyl alcohol, carboxymethyl cellulose, methyl cellulose, sodium polyacrylate, ethyl cellulose, alginic acid, starch, polyvinyl methyl ether, polyvinyl ethyl ether and the like, or polyvinylpyrrolidone, polyethylene oxide, casein and the like.

Among them, polyvinyl alcohol and a copolymer of vinylalcohol are particularly excellent with respect to humidity resistance. As the copolymer of vinyl alcohol, a copolymer containing more than 60 mol%, in particular, more than 20 mol% of vinyl alcohol, is preferable.

The resin grinder of the present invention is prepared typically by dispersing an abrasive in a solution of resin and coating the dispersion onto the surface of a support such as web, film, roller, metal foil and the like followed by drying. As another method, resin is melted by heating and then an abrasive may be dispersed in the melted resin. Alternatively, an abrasive may be dispersed in a monomer substance of low polymerization degree or solution thereof, from which a resin can be formed. Then the resulting dispersion is coated onto a supporting material, and thereafter a resin containing the abrasive dispersed therein may be formed. In a further method, a resin containing an abrasive dispersed therein may be adhered to a support by means of an adhesive.

The particle size of the abrasive contained in resin may be usually 0.01–20 microns, and preferably 0.1–10 microns.

The contact-abrading means may be used simultaneously with a cleaning means for the image-holding member as illustrated in FIG. 1. That is, the contact-abrading means can be used alone without a cleaning means, or can be used together with a conventional cleaning means such as brush, blade and the like. When the contact-abrading means is used together with another cleaning means, it is appropriate that the contact-abrading means is disposed in such a manner that the abrading treatment is carried out subsequent to a cleaning treatment.

The contact-abrading means may be brought into contact with the surface of the image-holding member in a plain plate or blade manner or in a rotating manner in the form of a roller.

The developer containing an abrasive is prepared by adding the abrasive particles to an ordinary developer.

The amount of the abrasive in the developer is usually 0.1–70% by weight, preferably 0.5–40% by weight, based on the total amount of developer and abrasive.

EXAMPLE 1

On an aluminum cylinder of 160$\phi$ and 40 cm in length was formed a photoconductive layer in the thickness of 50 microns. The photoconductive layer was composed of CdS powders dispersed in a vinyl chloride-vinyl acetate copolymer resin. Then a photocurable urethane resin (trade-name, Sonne, supplied by Kansai Paint Co., Ltd.) was applied onto the photoconductive layer by a soaking method followed by curing by light to form an insulating layer 30 microns in thickness. This sample is called "Sample (A)".

On a photoconductive layer prepared by the above-mentioned procedure was formed an insulating layer composed of the above-mentioned photocurable urethane resin 20 microns in thickness. Then another insulating layer of the above-mentioned photocurable urethane resin containing 30% by weight of polytetrafluoroethylene particles (tradename, L-2, supplied by Daikin) based on the total amount of about 0.2 microns in size as the lubricating agent was formed in a thickness of 10 microns on the above-mentioned insulating layer. The resulting sample is called "Sample (B)".

Sample (A) and Sample (B) were subjected to primary charging at +7 KV, AC discharging simultaneously with exposure, blanket exposure, developing with a dry developer, and a test for durability.

Sample (A) showed a friction coefficient as high as 3.0 and did not smoothly rotate, and the cleaning blade edge was immediately broken.

Sample (B) was smoothly cleaned until 600 rotations, but the friction coefficient gradually increased and at 1000 rotations the rubbing sound became very loud and the image quality was deteriorated to a great extent.

Then, a developer in which 0.8% by weight of cerium oxide based on the total amount was incorporated as an abrading means, was used. The coefficient of friction of Sample (A) was as high as 3.5 and Sample (A) was not suitable for practical use while the coefficient of friction of Sample (B) was as low as 1.2. The resulting image quality was excellent, no fusion of a toner on the surface of Sample (B) was observed, contaminating matters formed by corona ion were clearly removed, and deterioration of lubricating property etc. was not caused even when rotation of the sample was repeated 50,000 times.

EXAMPLES 2–6

The insulating layer containing a lubricating agent in the image-holding member and the abrading means in Example 1 were replaced by those as shown in Examples 2–6 below, and lubricating property etc. of each of the resulting image-holding members was examined. Good results were obtained to the result of Sample (A) used together with the abrading means in Example 1.

EXAMPLE 2

Insulating layer: Polyester resin (trade-name, Aronix, supplied by Toagosei Chemical Industry Co., Ltd.) . . . 90 parts by weight Lubricating agent, polyethylene particles of 5 microns in size . . . 10 parts by weight Abrading means: 1.5% by weight of calcium carbonate based on the total amount of 0.8 microns in size was added to the developer.

EXAMPLE 3

Insulating layer: Epoxy resin (trade-name, V5501, supplied by Dai Nippon Ink Co., Ltd.) . . . 70 parts by weight Lubricating agent, polyethylene particles of 5 microns in size . . . 30 parts by weight Abrading means: Cleaning blade (5% by weight of cerium oxide based on the total amount of 1 micron in size contained in urethane rubber) EXAMPLE 4

Insulating layer: Silicone resin (trade-name, X-12-917, supplied by Shinetsu Kagaku) . . . 95 parts by weight Lubricating agent, talc of 2 microns in size . . . 5 parts by weight Abrading means: 4% by weight of magnesium sulfate based on the total amount of 4 microns in size contained in a cleaning web.

EXAMPLE 5

Insulating layer: Melamine resin (trade-name, CA105, supplied by Nippon Oils and Fats Co., Ltd.) . . . 75 parts by weight Lubricating agent, calcium stearate of 0.8 microns in size . . . 25 parts by weight Abrading means: Cleaning blade (5% by weight of carbon black based on the total amount of 2 microns in size contained in urethane rubber).

EXAMPLE 6

Insulating layer: Acrylic resin (trade-name, Pulslac No. 2000, supplied by Chugoku Marine Paints Co., Ltd.) . . . 96 parts by weight Lubricating agent, polyethylene terephthalate of 0.2 microns in size . . . 4 parts by weight Abrading means: 3% by weight of magnesium oxide based on the total amount of 2 microns in size contained in the developer

EXAMPLE 7

80 Parts by weight of CdS, 15 parts by weight of a thermosetting urethane binder (trade-name, TOA URETHANE, supplied by Toa Urethane), and 5 parts by weight of polyethylene particles of 4 microns in size were coated on an aluminum cylinder by a soaking method and treated by heat at 80° C. for 2 hours to cure.

The resulting pohotosensitive member was subjected to a negative charging and an imagewise exposure (Carlson process) to form latent images followed by development (Carlson process). The cleaning property of the developer was examined.

When 0.8% by weight of cerium oxide based on the total amount of 2 microns in size was added to the developer, the cleaning property immediately increased and transferring efficiency of the developer was improved.

EXAMPLE 8

A photocurable urethane resin (trade-name, Sonne, supplied by Kan Sai Paint Co., Ltd.) was coated on an aluminum drum support (200$\phi \times$500 mm) by a soaking method, cured by irradiating a 4 KW mercury lamp for 4 min. to form an insulating layer of 10 microns in thickness. And further a coating material composed of the same photocurable urethane resin and 30% by weight of polytetrafluoroethylene particles (trade-name, L-2, supplied by Daikin) of about 0.2 microns in size as a lubricating agent was applied to the insulating layer to form another insulating layer in a thickness of 5 microns. As a result, there was formed an insulating layer 15 microns thick in totality on the support to produce an image-holding member.

To the resulting image-holding member was applied a process for producing electrostatic latent images on an image-holding member comprising modifying corona discharge by electrostatic images formed on a CdS screen photosensitive member. Even after the image formation was repeated 50,000 times, the cleaning property at the surface of the image-holding member was good, and good images of a high contrast were obtained.

Durability of the image-holding member was measured by a CdS screen photosensitive member as shown below. Onto a stainless steel network (openings of about 50 microns in width) was attached a photoconductive layer of 30 microns in thickness by spray coating. Composition of the photoconductive layer consisted of CdS powders (70 parts by weight) and silicone resin (trade-name, KR-255, supplied by Shinetsu Kagaku Co., Ltd.) (30 parts by weight). The photoconductive layer was dried at 80° C. for 15 min. And then an insulating layer of 15 microns in thickness was formed on the photoconductive layer by spray coating. The insulating layer consisted of a silicone resin (trade-name, TSR-144, supplied by Toshiba Silicone Co., Ltd.) containing a curing agent (trade-name, CR-15, supplied by Toshiba Silicone Co., Ltd.).

The surface of the resulting screw photosensitive member was charged at +450 V, imagewise exposed simultaneously with AC discharging to form electrostatic latent images having −50 V at the light portion and +200 V at the dark portion. An image-holding member was disposed at the side of the stainless steel network side of the screen, photosensitive member and a negative corona charging was conducted by way of the screen photosensitive member. And then the electrostatic image thus formed on the sample were developed with a toner and the toner images thus obtained were transferred to a paper by a transferring voltage of about −6 KV and fixed to obtain visible images. After the transferring, the image-holding member was subjected to an abrading treatment with a blade (urethane rubber containing 5% by weight of cerium oxide based on the total amount of 1 micron in size).

EXAMPLE 9

100 parts by weight of cerium oxide particles of 4 microns in size and 10 parts by weight of a vinyl alcohol (90 mol %)-vinyl acetate (10 mol %) copolymer resin (trade-name, B-17, supplied by Denki Kagaku Kogyo) were dispersed and dissolved in 100 parts by weight of water followed by agitating thoroughly at 10,000 r.p.m. for 10 min. by a homogenizer. The resulting coating material was applied to a paper web in an amount of 10 g/m$^2$(as solid) by a bottom feed reverse coater and passed through a drying furnace of 10 m in length at 100° C. to produce an abrading member.

There was prepared a photosensitive member comprising: an aluminum cylinder, a photoconductive layer of 35 microns in thickness compossed of 88 parts by weight of cadmium sulfide and 12 parts by weight of a vinyl chloride-vinyl acetate copolymer resin dispersion in which the cadmium sulfide was dispersed, the photoconductive layer overlying the surface of the aluminum cylinder, and an insulating layer having thickness of 30 microns overlying the photoconductive layer. The insulating layer is composed of a curable silicone resin (trade-name, X-12-917, supplied by Shinetsu Kagaku Co., Ltd.) containing 30% by weight of poly tetrafluoroethylene particles of 0.2 microns in size.

The resulting photosensitive member was subjected to a primary charging, +7 KV corona charging, a secondary charging by A.C. 7.5 KV corona charging simultaneously with imagewise exposure at 3.0 lux.sec, a blanket exposure to form electrostatic images, a dry development with a toner to produce toner images, transferring the resulting toner to a receiving paper, cleaning with a blade made of urethane rubber, and an abrading treatment in such a manner that the above-mentioned abrading member was brought into contact with the surface of the photosensitive member at a rate of fading 0.1 mm of the abrading member per one rotation of the photosensitive member.

Even after the electrophotographic process was repeated 250,000 times, no fixing of the toner onto the surface of the photosensitive member or lowering of surface electric resistance was observed. And the resulting copy images obtained after 250,000 times still have the same image quality as the copy images at the beginning.

When the abrading treatment was not employed in the above procedure, there was observed a toner fixed to the surface of the photosensitive member at about 1000 cycles of the electrophotographic process, and fog was observed in toner images transferred to a receiving paper.

EXAMPLE 10

By repeating the procedure of Example 9 except that silicon oxide, calcium carbonate or barium oxide was used in place of cerium oxide, there was prepared an abrading member, and an experiment similar to that in Example 9 was conducted. Even after 90,000 times of repeating the electrophotgraphic process, there was no fusion of the toner on the surface of the photosensitive member, and clear and sharp toner images were obtained.

EXAMPLE 11

The following experiment was effected by using an abrading member and a photosensitive member of Example 9.

The photosensitive member was subjected to a primary corona charging at +7 KV, a secondary A.C. corona charging at 7.5 KV simultaneously with imagewise exposure (3.1 lux.sec), a blanket exposure of 200 lux.sec to form electrostatic images, and abrading by the abrading member in a way similar to Example 9 at 35° C. at a relative humidity of 85%.

The above electrophotographic process was repeated 5000 times, and the electrostatic latent images formed after 5000 times were developed by a dry toner and transferred to a receiving paper. The resolution of the toner images on the receiving paper was 8 lines/mm and the toner images were clear and sharp.

When abrading was not effected by the abrading member in the present example, the toner images formed on the receiving paper were not clear and the resolution could not be determined.

EXAMPLE 12

Repeating the procedure of Example 9 except that each of the following linear resins (1)–(3) was employed in place of the polyvinyl alcohol copolymer (trade-name, B-17, supplied by Denki Kagaku Kogyo), there was obtained an abrading member. Then the same test was applied.

Even after repeating the process 250,000 times, there were not observed any flying-out of an abrading agent, contamination of toner by the abrading agent, fusion and fixing of toner onto the surface of the photosensitive member and lowering of surface electric resistance, and all the resulting copy images were of good quality and were able to be practically used.

(1) Polyvinyl alcohol resin (trade-name, K-17, supplied by Denki Kagaku Kogyo)

(2) Carboxymethyl cellulose resin (trade-name, DAICE L-CMC, supplied by Daicel Co., Ltd.)

(3) Ethylcellulose resin (trade-name, Metolose, supplied by Shinetsu Kagaku)

EXAMPLE 13

There was repeated the procedure of Example 9 except that each of the following non-linear curable resins (1)–(4) and linear resins (5)–(9) was employed in place of the vinyl alcohol copolymer (tradename, B-17, Denki Kagaku Kogyo). Abrading capacity of the abrading members produced by resins (1)–(4) disappeared when the electrophotographic process was repeated 5,000 times, that of the abrading member produced by resin (5) disappeared at a repetition of 8,000 times, and that of the abrading members (6)–(9) disappeared at a repetition of 50,000 times. After disappearance of the abrading capacity in each case, there occurred fusion and fixing of toner to the surface of the photosensitive member and unclear images were formed.

(1) Photocurable polyester resin (trade-name, UV-102, supplied by Cashew Co., Ltd.)

(2) Photocurable epoxy resin (tradename, W-4, supplied by Dainichiseika Color and Chemicals Mfg. Co., Ltd.)

(3) Thermosetting silicone resin (trade-name, S-144, supplied by Teijin Kasei Co., Ltd.)

(4) Thermosetting acrylic resin (trade-name, Pulslac, supplied by Chugoku Marine Paints Co., Ltd.) (5) Phenoxy resin (trade-name, PKHH, supplied by Union Carbide Co., Ltd.)

(6) Polyether resin (trade-name, Polyethylene glycol #6000, supplied by Nippon Oils and Fats Co., Ltd.)

(7) Polycarbonate resin (trade-name, Panlite, supplied by Teijin Kasei Co., Ltd.)

(8) Vinyl chloride-vinyl acetate copolymer resin (trade-name, VMCH, supplied by Union Carbide Co., Ltd.)

(9) Polyacrylate resin (trade-name, U-polymer, supplied by Unitika Co., Ltd.)

What we claim is:

1. In an electrophotographic apparatus which comprises an image holding member for electrostatic images and/or toner images having a surface layer subject to residual toner build-up and/or corona ion-induced electrical deterioration byproducts which reduce image quality and inhibit toner removal after image transfer, the improvement comprising:

(a) a solid particulate lubricating agent contained in the surface layer, said lubricating agent being capable of increasing the lubricating property of the surface of said layer and;

(b) means to abrade the surface layer to expose a new surface of said layer and to maintain an effective exposure of said lubricating agent, wherein said lubricating agent is consumed to increase the lubricating property of the surface and aid in reducing by-products and toner build-up.

2. An electrophotographic apparatus according to claim 1 in which the surface of the image-holding member containing a lubricating agent is an insulating layer composed of a lubricating agent dispersed in a resin.

3. An electrophotographic apparatus according to claim 1 in which the lubricating agent is in a form of powder having a particle size ranging from 0.1 to 20 microns.

4. An electrophotographic apparatus according to claim 1 in which the means to abrade is composed of a contact-abrading member and an abrasive.

5. An electrophotographic apparatus according to claim 4 in which the contact-abrading member is a resin grinder composed of abrasive particles dispersed in a resin.

6. An electrophotographic apparatus according to claim 4 in which the abrasive is selected from the group consisting of metal oxides, metal sulfates and metal carbonates.

7. An electrophotographic apparatus according to claim 5 in which the abrasive is selected from the group consisting of metal oxides, metal sulfates, metal silicates and metal carbonates.

8. An electrophotographic apparatus according to claim 5 in which the resin containing dispersed abrasive particles is a resin of linear structure.

9. An electrophotographic apparatus according to claim 5 in which the resin containing dispersed abrasive particles has a pencil hardness ranging from 0.5 H to 3.0 H.

10. An electrophotographic apparatus according to claim 5 in which the resin containing dispersed abrasive particles is a water soluble resin.

11. In an electrophotographic apparatus which comprises an image holding member for electrostatic imates and/or toner images having an insulating layer at the surface subject to residual toner build-up and/or corona ion-induced electrical deterioration by-products which reduce image quality and inhibit toner removal after image transfer the improvement comprising:

(a) a solid particulate lubricating agent contained in the insulating layer, said lubricating agent being capable of increasing the lubricating property of the surface of said layer and;

(b) a contact-abrading member to abrade the surface of the insulating layer to expose a new surface of said layer to maintain an effective exposure of said lubricating agent; wherein said lubricating agent is consumed to increase the lubricating property of the surface and aid in reducing by-products and toner build-up.

12. An electrophotographic apparatus according to claim 11 in which the contact-abrading member is a resin grinder composed of abrasive particles dispersed in a resin.

13. An electrophotographic apparatus according to claim 12 in which the resin grinder is a resin having a pencil hardness ranging from 0.05 H to 3.0 H and containing dispersed abrasive particles.

14. An electrophotographic apparatus which comprises:

(a) an image holding member for holding electrostatic images and/or toner images having a surface subject to residual toner build-up and/or corona ion-induced electrical deterioration by-products, which reduce image quality and inhibit toner removal after image transfer, and;

(b) a resin grinder means to abrade the surface of said member to expose new surface, said resin grinder comprising a water-soluble, resin-containing abrasive, whereby the tendency for toner build-up and/or by-products build-up is reduced.

* * * * *

UNITED STATES PATENT AND TRADEMARK OFFICE

CERTIFICATE OF CORRECTION

PATENT NO. : 4,279,500

DATED : July 21, 1981

INVENTOR(S) : HIDEYO KONDO, ET AL.

It is certified that error appears in the above—identified patent and that said Letters Patent is hereby corrected as shown below:

Column 9, line 51, after "rubber)" delete -- EXAMPLE 4 --.
Column 9, after line 51, insert -- EXAMPLE 4 --.
Column 10, line 18, "pohotosensitive" should be -- photosensitive--
Column 11, line 1, "screw" should be -- screen --.
Column 11, line 34, "compossed" should be -- composed --.
Column 11, line 56, "fading" should be -- feeding --.
Column 12, line 10, "electrophotgraphic" should be -- electro-photographic --.
Column 13, line 13, after "Co., Ltd.)" delete -- (5)Phe- --.
Column 13, line 14, before "noxy resin" insert -- (5)Phe --.
Claim 1, Column 13, line 31, "byproducts" should be -- by-products-
Claim 11, Column 14, line 20, "imates" should be -- images --.

Signed and Sealed this

*Sixth* Day of *October 1981*

[SEAL]

*Attest:*

GERALD J. MOSSINGHOFF

*Attesting Officer*

*Commissioner of Patents and Trademarks*